US005446928A

United States Patent [19]

Daniels

[11] Patent Number: 5,446,928

[45] Date of Patent: Sep. 5, 1995

[54] LIFT TO FLUSH TOILET STOOL

[76] Inventor: Raymond R. Daniels, 8 Ambleside Dr., Bellaire, Fla. 34616

[21] Appl. No.: 329,875

[22] Filed: Oct. 27, 1994

[51] Int. Cl.[6] ..... E03D 5/04; E03D 11/17

[52] U.S. Cl. ..... 4/434; 4/DIG. 13; 4/DIG. 16; 4/420

[58] Field of Search ..... 4/434, DIG. 13, DIG. 16, 4/420, 435, 436

[56] References Cited

U.S. PATENT DOCUMENTS

| | | | |
|---|---|---|---|
| D. 231,930 | 6/1974 | Danks | 4/DIG. 16 |
| 4,028,746 | 6/1977 | Huck | 4/DIG. 13 |
| 4,091,473 | 5/1978 | Matthews et al. | 4/420 |
| 4,750,219 | 6/1988 | Williams | 4/DIG. 13 |
| 5,257,422 | 11/1993 | Rügg | 4/DIG. 16 |

FOREIGN PATENT DOCUMENTS

| | | | |
|---|---|---|---|
| 42637 | 4/1977 | Japan | 4/DIG. 13 |
| 1683 | 7/1858 | United Kingdom | 4/420 |

*Primary Examiner*—Henry J. Recla
*Assistant Examiner*—Charles R. Eloshway
*Attorney, Agent, or Firm*—Harold D. Shall

[57] ABSTRACT

A toilet stool including a bowl supported above the ground, a flexible hose connecting the bowl to a sewer pipe and a support member for releasably retaining the flexible hose in a trap configuration. The bowl is lifted and the flexible hose substantially straightened to flush the toilet stool.

12 Claims, 2 Drawing Sheets

LIFT TO FLUSH TOILET STOOL

BACKGROUND OF THE INVENTION

1. Field of the Invention

This invention relates to flushable toilet stools generally and more particularly to a toilet stool which is flushed by lifting the same.

2. Description of the Prior Art

The prior art shows many portable toilet stools and also flushable toilets are well known in the Art. However, portable toilet stools for use in camp grounds having sewer systems to which the toilet stool is connected and which are flushed by merely lifting the toilet stool are not known.

SUMMARY OF THE INVENTION

The present invention is a portable toilet stool that is usable in conjunction with a sewer line connection of a sewer system. The toilet stool is connected to the sewer line connection by a flexible pipe and a support holds the flexible pipe in a trap configuration. Water is placed in the bowl of the toilet stool to partially fill the bowl and the trap in the pipe to the appropriate well know trap level. After the toilet stool has been used for personal purposes, the toilet stool is flushed by lifting the toilet stool vertically so that the trap is partially straightened and so that the water trap and the toilet stool then flushes through the flexible pipe into the sewer system. After the flushing action is completed, the toilet stool lowered, the trap configuration in the flexible pipe is re-established and water from a suitable source, such as a hose, is placed in the toilet stool to again fill the later and also fill the trap to seal the toilet stool from the sewer line.

DETAILED DESCRIPTION

Figure 1:
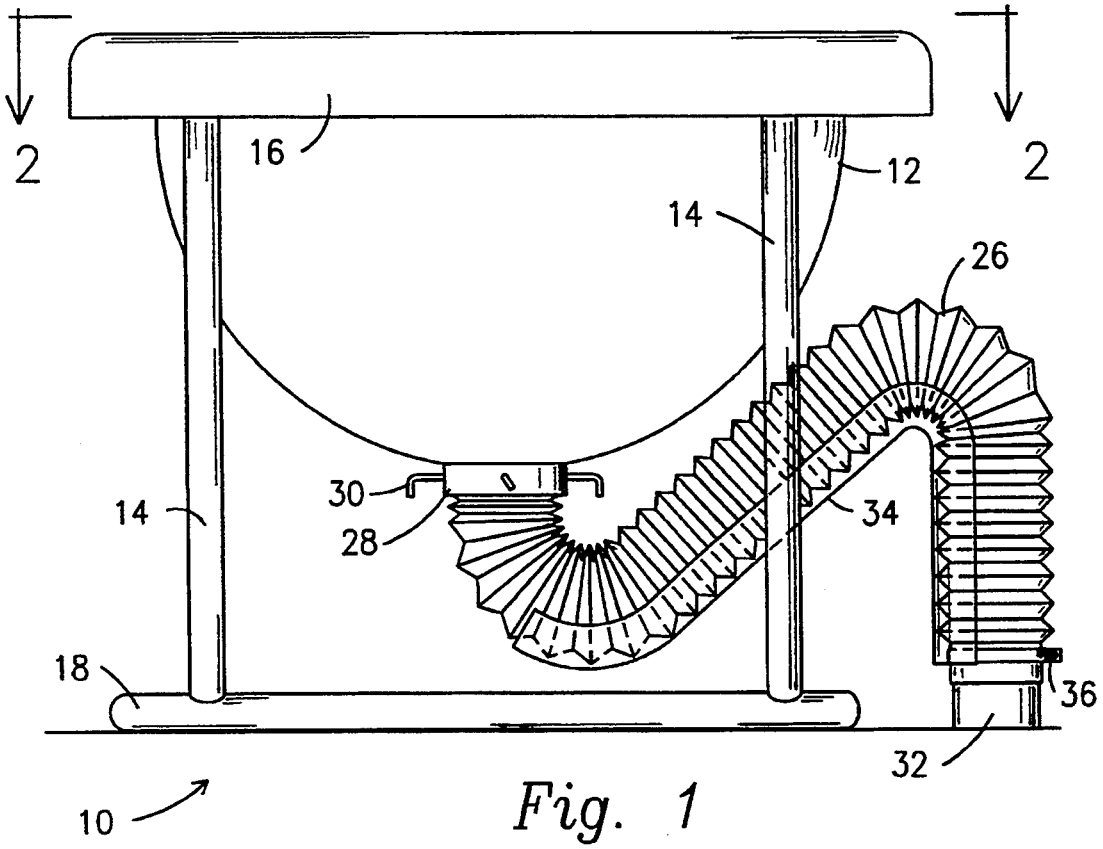
FIG. 1 is a side elevational view of a toilet stool of this invention shown connected to the fitting of a sewer line in its ready to use position.

Referring now to the drawings, a toilet stool is shown generally at 10 and includes a bowl member 12, preferably made of a rigid plastic such as PVC or of stainless steel and a plurality of vertical support members 14 secured under a lip portion 16 of the bowl member, which support members are fixedly secured at their lower ends to an annular support member 18. The support member 18 is adapted to rest on the ground and has a slot 20 formed therein for a purpose hereinafter described.

The bowl 12 has an opening 22 therein surrounded by a flange 24 and secured about the flange 24 is the upper end of a flexible hose 26 of the type which is available from an RV supply house and is used to connect the RV to a sewer line. The hose 26 is secured on the outside of the flange 24 by a clamp 28 having a plurality of set screws 30 therein. The hose 26 extends and is connected to the conventional fitting 32 of a sewer system of the type normally found at a camp ground or a RV park.

Figure 2:
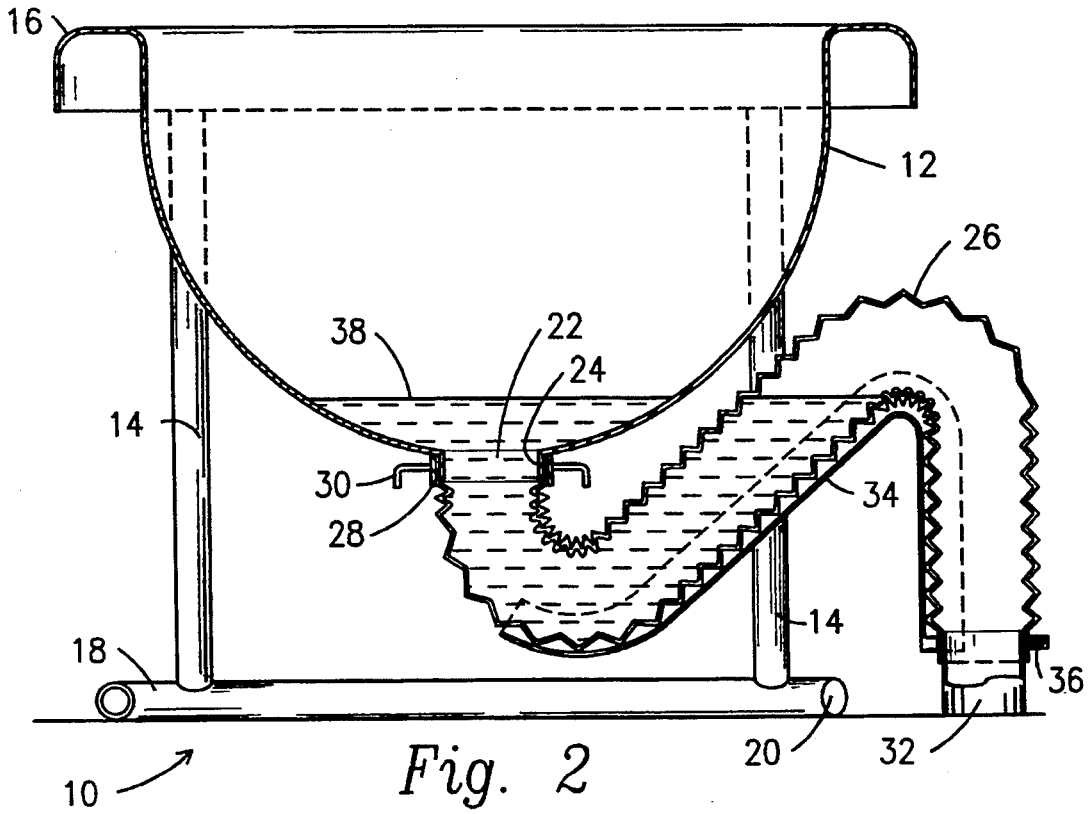
FIG. 2 is a cross sectional view taken along the lines 2—2 in FIG. 1.
Figure 3:
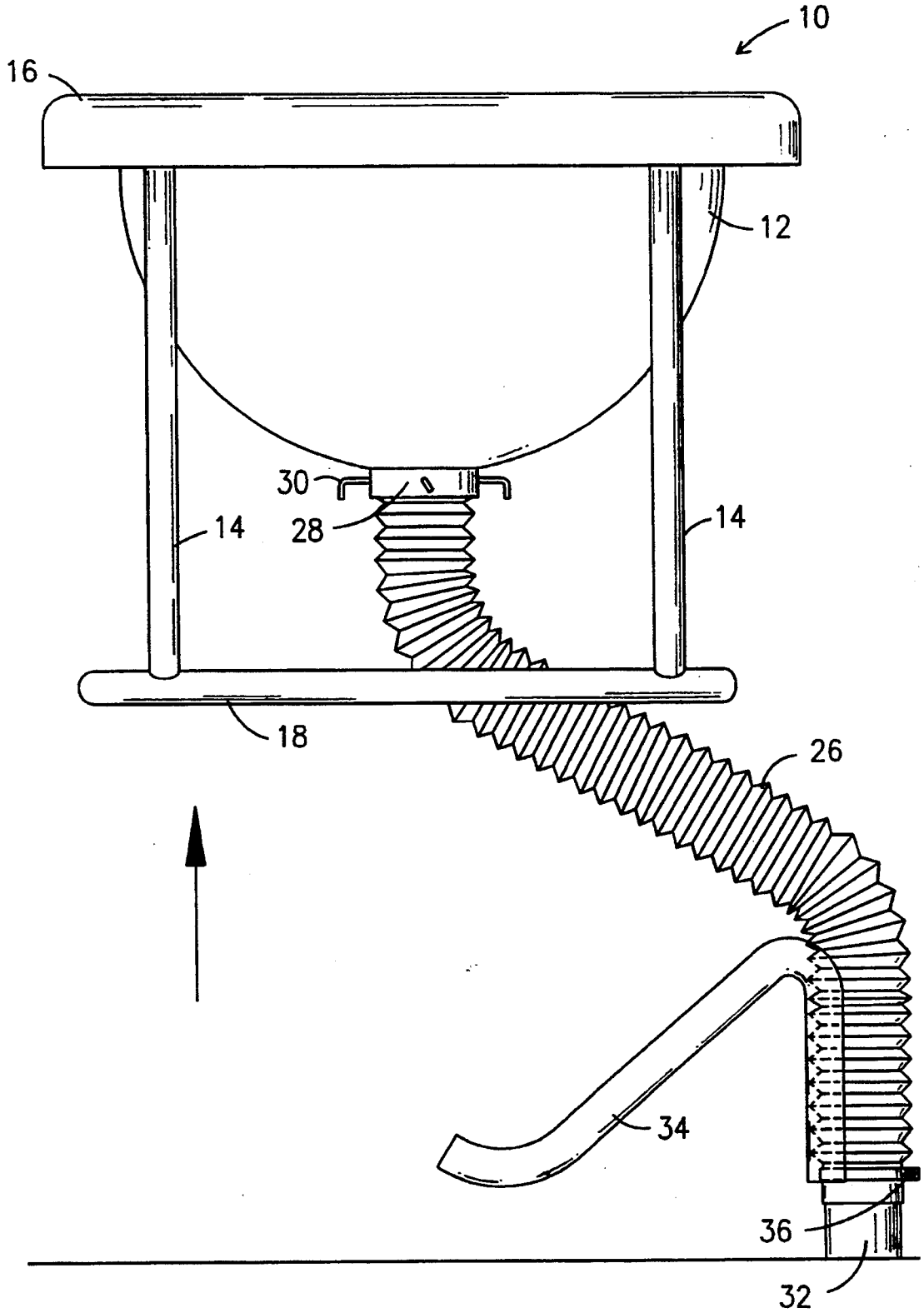
FIG. 3 is a side elevational view of the toilet stool of FIG. 1 in its lifted or flushing position.

A rigid trap shaped support member 34 is secured about the lower end of the hose 26, where the latter is fitted on the fitting 32, by a screw clamp 36 formed integrally with the support member 34 whereby both the support member 34 and the hose 26 are firmly secured to the fitting 32. The member 34 may be made of a metal stamping or can be of a suitable rigid plastic such as PVC. The support member 34 extends upwardly from the fitting 32, then curves downwardly and then recurves back upwardly, and receives the hose 26 and supports the hose, when the toilet stool is in its "down" position, in a trap configuration. Water 38 is placed in the bowl 12 as by a hose (not shown) and the water fills the hose 26 in a trap-like manner as shown in FIG. 2. After the toilet stool 10 has been used, the toilet stool is raised to the position shown in FIG. 3 and the contents of the bowl 12 along with the water 38 is flushed into the sewer through the hose 26 and the fitting 32.

When the toilet stool 10 is raised, the hose 26 passes through the slot 20 formed in the annular member 18. After the above described flushing operation, the toilet is again lowered so that the support member 18 is on the ground and a new supply of water 38 is introduced into the bowl 12 and from the latter into the trap portion of the flexible hose 26.

Although the above description relates to a presently preferred embodiment, numerous changes can be made therein without departing from the scope of this invention as claimed in the following claims.

What is claimed is:

1. A portable latrine directly connectable to a sewer pipe emanating from the ground, comprising:

a) a bowl;

b) a support attached to said bowl for supporting the bowl on the ground;

c) a flexible hose having a flexible hose bowl end attached to said bowl and a flexible hose sewer pipe end directly attachable to said sewer pipe emanating from the ground;

d) sewer pipe connecting means for securing said flexible hose sewer pipe end to the sewer pipe; and e) a substantially "S" shaped member having a substantially "S" shaped member sewer pipe end attached to said sewer pipe connecting means, said substantially "S" shaped member allowing said flexible hose to rest thereon; wherein, when said portable latrine rests on the ground said flexible hose is maintained in a trap-like configuration by the substantially "S" shaped member and when said portable latrine is raised above the ground said flexible hose no longer rests on said substantially "S" shaped member and said trap configuration is removed from said flexible hose allowing waste in said bowl to leave said bowl, pass through said flexible hose and enter the sewer pipe so that said portable latrine is automatically flushed when said portable latrine is lifted off the ground.

2. The latrine as defined in claim 1, wherein said substantially "S" shaped member sewer pipe end and said sewer pipe connecting means are integrally formed.

3. The latrine as defined in claim 1, wherein said sewer pipe connecting means is selected from a group consisting of clamp, elastic band, spring, and friction coupling.

4. The latrine as defined in claim 1, wherein said bowl has a bowl lower end containing a bowl lower end flanged opening to which said flexible hose bowl end is secured.

5. The latrine as defined in claim 1, wherein said substantially "S" shaped member has a cross section that is concaved so that said flexible hose is cradled thereby.

6. The latrine as defined in claim 1, wherein said support has a support upper portion on which said bowl rests, a support lower portion displaced a distance from said upper portion, and support rails that connect said support upper portion to said support lower portion.

7. The latrine as defined in claim 6, wherein said bowl has a bowl upper surface with a bowl upper surface flange that receives said support upper portion.

8. The latrine as defined in claim 6, wherein said support lower portion contains a support lower portion slot so that when said bowl is raised above the ground said flexible hose can pass through said support lower portion when the sewer pipe is disposed outside said support lower portion.

9. The latrine as defined in claim 1, wherein said flexible hose sewer pipe end is adapted to fit in the sewer pipe.

10. The latrine as defined in claim 1, wherein said flexible hose sewer pipe end is adapted to fit around the sewer pipe.

11. The latrine as defined in claim 1; further comprising bowl connecting means for connecting said flexible hose bowl end to said bowl.

12. The latrine as defined in claim 11, wherein said bowl connecting means is selected from a group consisting of clamp, elastic band, spring, and friction coupling.

* * * * *